US005267006A

United States Patent [19]

Miskinis et al.

[11] Patent Number: 5,267,006

[45] Date of Patent: Nov. 30, 1993

[54] TAPERED SKI SUPPORTS FOR A FILM CLEANING DEVICE

[75] Inventors: Edward T. Miskinis; Orville C. Rodenberg, both of Rochester; Gary B. Bertram, Honeoye Falls; Bruce D. MacLellan, Ontario, all of N.Y.

[73] Assignee: Eastman Kodak Company, Rochester, N.Y.

[21] Appl. No.: 971,130

[22] Filed: Nov. 4, 1992

[51] Int. Cl.[5] ..... G03G 21/00

[52] U.S. Cl. ..... 355/296; 355/212; 355/301

[58] Field of Search ..... 355/296, 301-305, 355/212; 118/652; 15/256.5

[56] References Cited

U.S. PATENT DOCUMENTS

| | | | |
|---|---|---|---|
| 4,230,406 | 10/1980 | Klett | 355/15 |
| 4,398,820 | 8/1983 | Thayer | 15/256.51 X |
| 4,499,849 | 2/1985 | Tomita et al. | 118/652 |
| 4,641,956 | 2/1987 | Seanor | 118/652 X |
| 4,723,144 | 2/1988 | Silverberg | 118/652 X |
| 4,797,708 | 1/1989 | Kasiske, Jr. et al. | 355/15 |
| 4,903,084 | 2/1990 | Baltrus et al. | 355/301 |
| 4,949,133 | 8/1990 | Landa | 355/296 |
| 5,210,582 | 5/1993 | Lundy et al. | 355/297 |

*Primary Examiner*—R. L. Moses

*Attorney, Agent, or Firm*—Leonard W. Treash, Jr.

[57] ABSTRACT

In electrographic apparatus a latent image on a flexible photoconductor is developed with toner particles at a development station and subsequently transferred to a receiver sheet, such as a copy sheet, and then fused to the sheet. Sometimes unwanted particles are on the photoconductor, including the area where an image is to be developed on the photoconductor. These particles are removed by a magnetic brush system located closely adjacent the surface of the photoconductor prior to the charging station. By means of a pair of tapered skis the cleaning pressure across the photoconductor is maintained at a uniform pressure during cleaning of the photoconductor so that the photoconductor is uniformly cleaned.

8 Claims, 4 Drawing Sheets

TAPERED SKI SUPPORTS FOR A FILM CLEANING DEVICE

BACKGROUND OF THE INVENTION

1. Field of the Invention

The present invention relates to apparatus for uniformly buffing and removing unwanted particles from the surface of a photoconductor, so that the photoconductor may be restored to a condition suitable for immediate re-use in an electrographic apparatus.

2. Description of the Prior Art

Images are formed in an electrographic apparatus by moving a photoconductor, in the form of a drum or flexible web, past a series of stations in the apparatus. As this occurs, the photoconductor is charged, exposed to form a latent charged image on the photoconductor, and the image is then developed by moving it past a development station where charged toner particles of developer material are attracted to the charged latent image to develop the image. The developed image is then transferred to a receiver sheet, such as a sheet of paper, at a transfer station. The receiver sheet, carrying the developed image, is advanced through a fusing station where the toner particles are heated and fused to the sheet. Particles remaining on the photoconductor, after transfer to the copy sheet has occurred, are removed at a cleaning station prior to recharging the photoconductor and repeating the copy process.

During the above processes of charging, developing, transfer and cleaning, each subsystem of the process interacts with the others. However, most interaction takes place between immediate neighboring systems. In the case of the cleaning subsystem, the effects of transfer and charging have the most effect on cleaning. The toner that remains behind on the photoconductor, after transfer, has to be cleaned off the photoconductor before the charger can uniformly charge the web, since the charging system is designed to charge a cleaned photoconductive surface. If the surface is not uniformly cleaned, the desired levels of charge needed on the photoconductor will not be achieved.

Since the photoconductor is used over and over again for thousands or perhaps hundreds of thousands of images, its surface must be continuously restored. Therefore, the photoconductor must be buffed, as well as cleaned, at a controlled and uniform rate. The required buffing rate is dependent upon the application. Sometimes it is necessary to buff the photoconductor very aggressively. A magnetic brush cleaner system is one of the typical systems used with electrophotographic copiers, printers and the like, to remove residual toner and buff the surface of the photoconductor after transfer. One type of magnetic brush cleaning system that is used has a very dense nap of coarse magnetic particles, but unfortunately, this type of nap has little compliancy. To overcome this compliancy problem when using a photoconductor belt in the form of a loop, one usually attempts to obtain the necessary compliancy by optimizing the loop support system in the vicinity of the cleaning apparatus in hopes of maintaining buffing uniformity over the width of the photoconductive web.

At the present time, one loop system that accomplishes the above consists of two stationary skis that straddle the cleaning brush where the deflection of the photoconductive belt occurs, between the two skis, to provide sufficient compliancy for cleaning. A problem with this technique is the lack of electrical uniformity along the photoconductor after normal cleaning due to uneven buffing which results in uneven wear and non-uniform electrical response of the photoconductor.

SUMMARY OF THE INVENTION

Accordingly, it is an object of the invention to provide a cleaning system for removal of unwanted particles from a flexible photoconductor that is not subject to precise installation tolerances.

The invention relates to an apparatus for cleaning a recording medium in the form of an endless belt extended between at least a pair of rollers, having a recording surface on which a developed image comprised of particles is formed and a back surface opposite said recording surface, the cleaning apparatus comprising:

means for removing residual particles on the recording surface, said means for removing being disposed on the recording surface side of said recording medium;

supporting means for supporting the back surface of the recording medium, said supporting means including:

a support member having supporting surfaces which face the back side of said recording medium, and the supporting surfaces are both curved and tapered for maintaining the recording surface in uniform pressure contact with the means for removing residual particles.

The main advantage of the present invention is its ability to adapt to magnetic brush cleaning nap that is not uniform.

BRIEF DESCRIPTION OF THE DRAWINGS

In the detailed description of the preferred embodiment of the invention presented below, reference is made to the accompanying drawings, in which.

DESCRIPTION OF A PREFERRED EMBODIMENT

Figure 1:
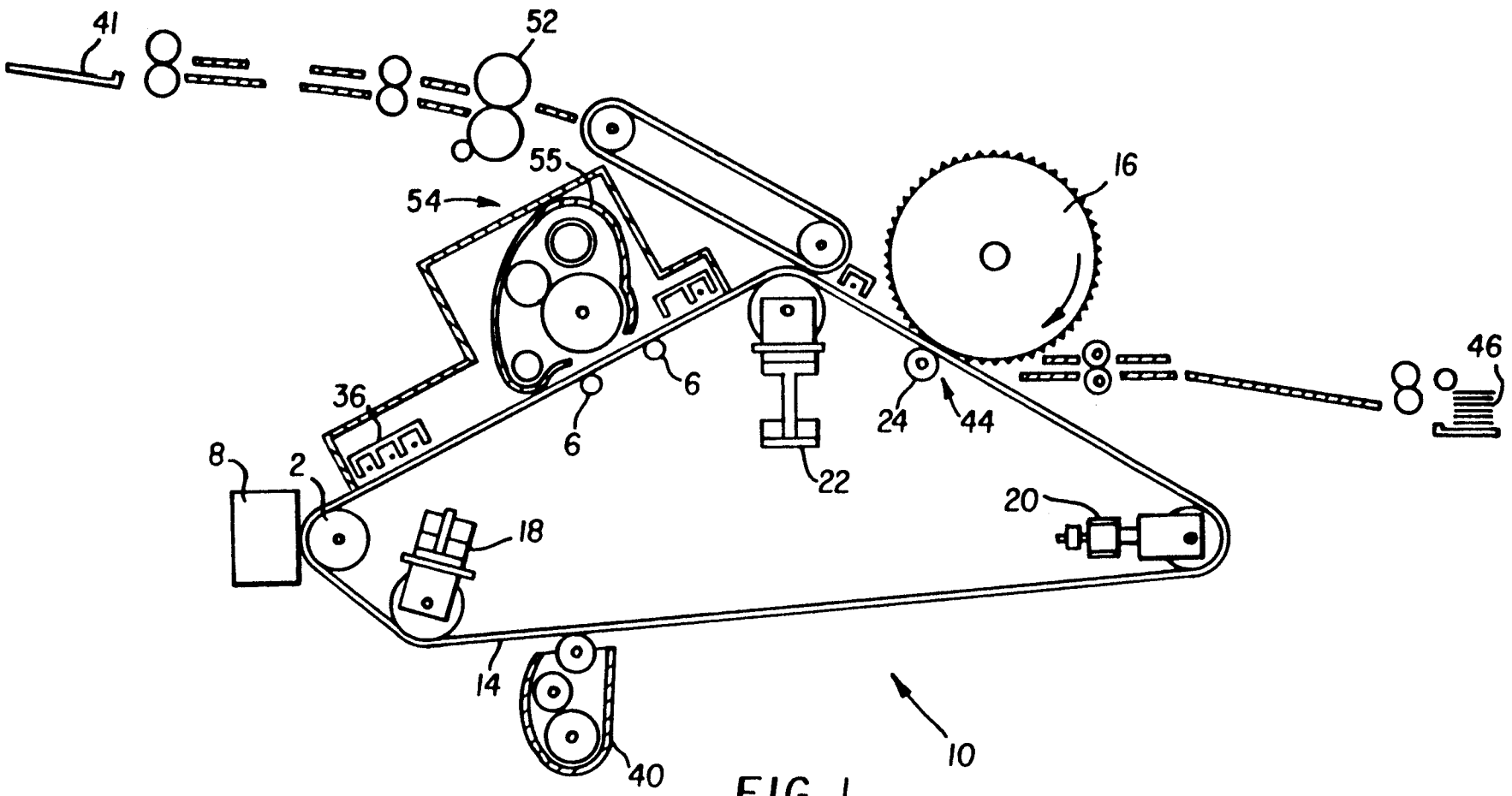
FIG. 1 (prior art)
FIG. 1 is a side schematic view of a portion of a prior art electrographic apparatus.

The apparatus of the preferred embodiment will be described in accordance with an electrostatographic recording medium. The invention, however, is not limited to methods and apparatus for creating images on such a medium, as other media such as photographic film, etc. may also be used to advantage within the spirit of the invention.

Because electrostatographic reproduction apparatus are well known, the present description will be directed in particular to elements forming part of, or cooperating more directly with, the present invention. Apparatus not specifically shown or described herein are selectable from those known in the art.

While the present invention is susceptible to embodiments of many different forms, there is shown in the drawings and hereinafter described, in detail, a preferred embodiment of the invention. It should be understood, however, that the present disclosure is to be considered an exemplification of the principles of the invention and is not intended to limit the invention to the embodiments illustrated and/or described.

For ease of description, all apparatus will be described in their normal operational position, and terms such as upper, lower, horizontal, etc., will be used with reference to normal operating positions. All apparatus, however, may be manufactured, stored, transported and sold in an orientation other than the normal operational positions described.

All references cited in this specification, and their references, are incorporated by reference herein where appropriate for appropriate teaching of additional or alternative details, features and/or technical background. L Throughout the following description, similar reference characters refer to similar elements or members in all of the drawing figures.

Referring initially to FIG. 1, a prior art film core portion of a copier or printer, generally designated 10, includes a recording medium, for example, an endless electrophotoconductive web 14 entrained about a series of rollers 18, 20 and 22 as well as other supporting structure. Web 14 is driven about rollers 18, 20 and 22 though a series of electrophotographic stations generally well-known in the art. More specifically, a uniform charge is laid down on web 14 by a charging station 36. Uniformly charged web 14 moves around printhead roller 2 which is directly opposite an LED printhead 8. LED printhead 8 exposes web 14 in a manner well-known in the art to form a latent image on web 14. Exposed web 14 then moves into operative relation with a toning or developing station 40. Each image, on web 14, created by printhead 8 is toned at toning station 40. The toned image, carried on web 14, then passes adjacent a transfer station 44 where the image is transferred to a transfer medium 46, such as a sheet of paper, carried by transfer drum 16.

Transfer drum 16, as is well known in the art, cooperates with web 14 to incrementally bring sheet 46 and the toned image into transfer relation so that the toned image is transferred to receiving sheet 46. After transfer is complete, sheet 46 is allowed to follow web 14 until it is separated from web 14 and transported to a fuser 52. After sheet 46 leaves fuser 52, it is directed to an output tray 41 for delivery to the apparatus operator.

Figure 3:
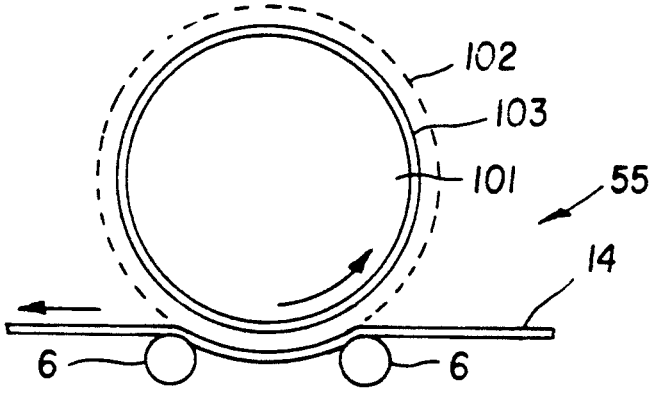
FIG. 3 (prior art)
FIG. 3 is an exploded side view of the prior art cleaning apparatus illustrated in FIG. 1.

That portion of web 14, from which separation of sheet 46 occurred, is then cleaned, by the application of a neutralizing corona, a neutralizing erase lamp and a magnetic brush cleaning mechanism all located at a cleaning carriage 54. Cleaning station 55, located in carriage 54, of the prior art (see FIGS. 1 and 3) includes a fixed magnetic core 101, having an outer shell 103 which is rotated in a counter-clockwise direction and a brush or fiber nap 102 consisting of magnetic particles, such as stainless steel, adhered to outer shell 103 as a result of the magnetic force of magnetic core 101. Skis 6 straddle cleaning station 55 and act as support members on that side of web 14 opposite from the recording surface side where the toned image is formed and magnetic brush 105 is brought into contact with web 14.

After leaving cleaning station 55, photoconductor belt 14 is subjected to recharging at charging station 36. An electrographic apparatus 10, as generally described hereinbefore, is known in the art and is disclosed, for example, in commonly assigned U.S. Pat. No. 4,821,066, entitled "Non-Impact Printer" which issued on Apr. 11, 1989 in the name of James C. Foote, Jr. et al.

Figure 2:
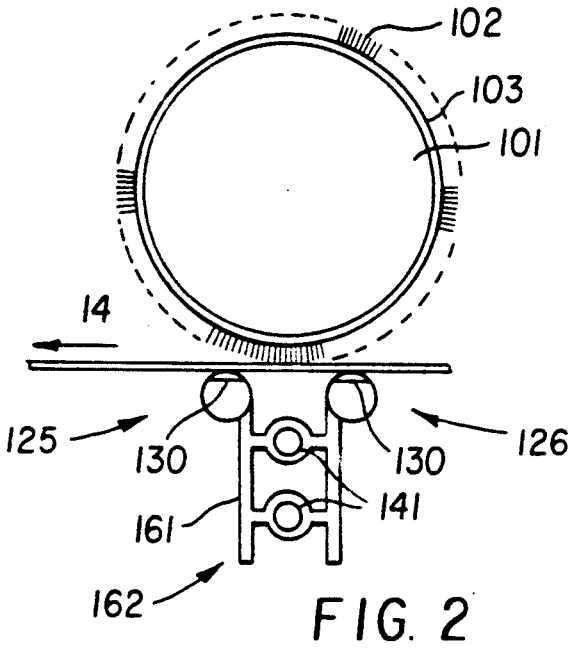
FIG. 2 is a side view of the cleaning apparatus of the present invention which replaces the cleaning apparatus shown in FIG. 1.
Figure 4:
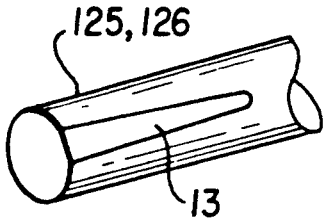
FIG. 4 is a prospective end view of the tapered ski in accordance with the present invention.
Figure 5:
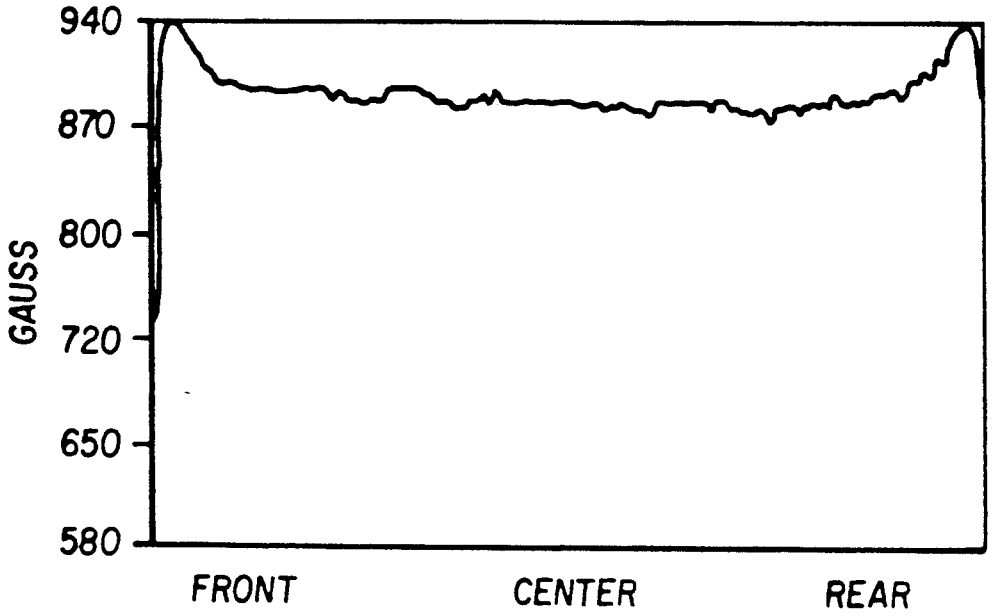
FIG. 5 is a graph of the magnetic profile of a magnetic cleaning brush assembly.
Figure 7:
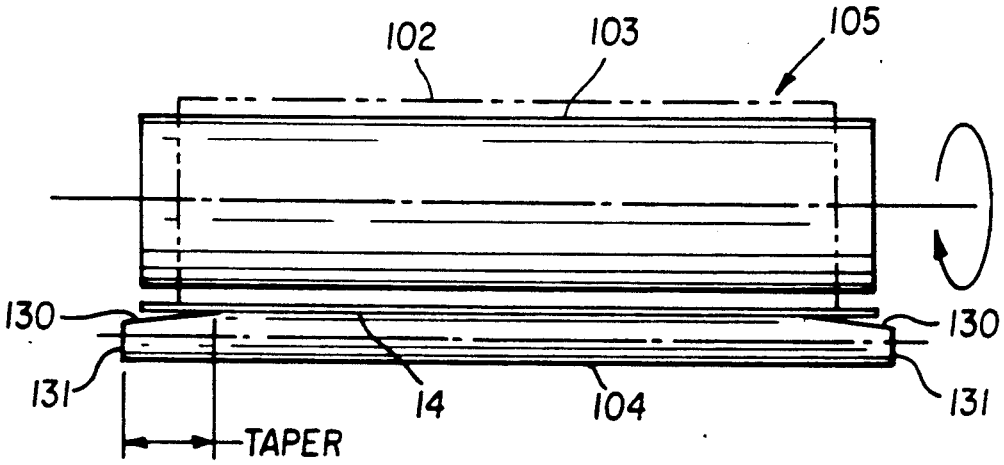
FIG. 7 is a front view of a tapered ski, of the present invention, in contact with the photoconductive web.
Figure 8:
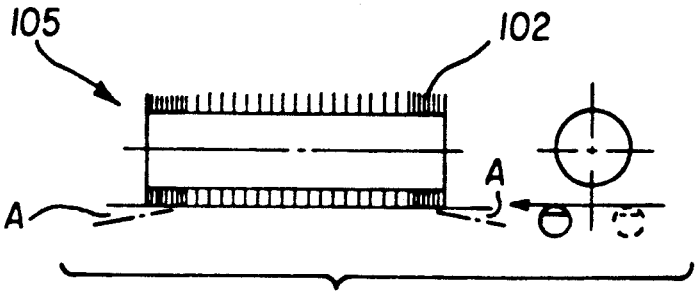
FIG. 8 is a front view of the space between the web and the skis to accommodate for the denser nap at the ends of the magnetic brush.
Figure 6:
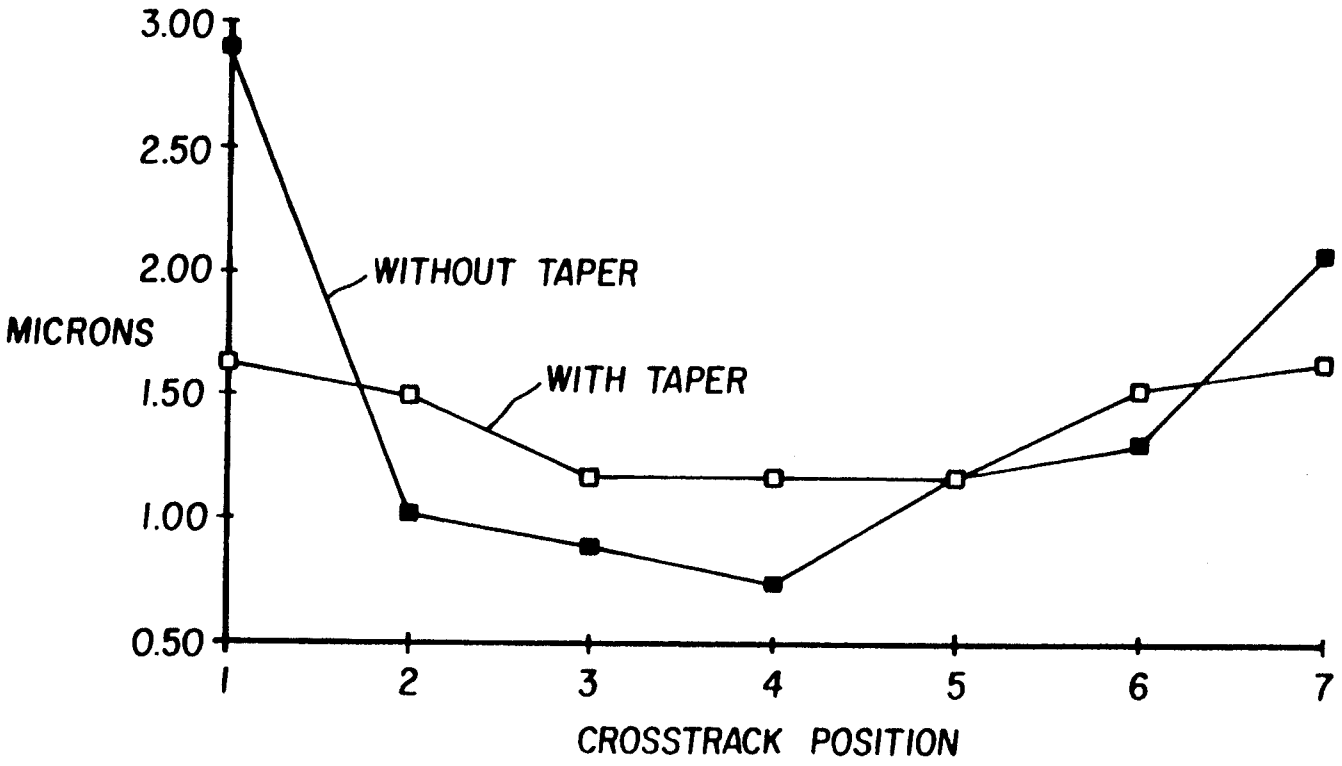
FIG. 6 is a graph comparing photoconductor wear uniformity between tapered and un-tapered skis.

In the present invention, skis 6 are replaced by dual skis 125 and 126 (see FIG. 2) located on the backside of belt 14 to position belt 14 with cleaning nap 102 of magnetic roller 105. When skis 125 and 126 are so positioned uniformly front to rear of shell 103 of magnetic cleaning roller 105 and cleaning nap 102, is uniform, from front to rear, belt 14 will be uniformly buffed. However, because the field of magnetic brush 105 is not uniform, even if skis 125 and 126 are uniformly positioned, belt 14 will not be evenly buffed due to the denseness of nap 102, in the areas of high magnetic fields, about the ends of magnetic brush 105. If skis 125 and 126, however, are designed to deviate a distance A (see FIG. 8) from the ends of magnetic brush 105, where the magnetic fields are peaked (see FIG. 5), the pressure on web 14 between the denser nap 102 and skis 125 and 126, will be reduced in those high magnetic field zones. This deviation is obtained by having a taper 130 (see FIGS. 4 and 7) in skis 125 and 126 to reduce the pressure at ends 131 of skis 125 and 126. Due to this reduction in pressure at ends 131, a substantially uniform pressure along the entire length of the nip formed by skis 125 and 126 and magnetic brush 105 may be maintained. This results in a uniform buffing of belt 14 and a substantially uniform belt wear pattern as shown in FIG. 6.

In the preferred embodiment of the design and mounting of skis 125 and 126, said skis are bracketed 1 inch apart, by a bracket 161 (see FIG. 2) and tapered approximately 1 inch to 2 inches from their ends 131 to a depth of 0.020 to 0.080 inches. A graph of the reduction in rate of wear, due to these tapers, is depicted in FIG. 6. To generate the data for said graph, twin skis 125 and 126 were spaced 0.065 from web 14 and the skis had a taper of 0.080 inches. In the graph of FIG. 6, the X axis represents the cross-track position of web 14 and the Y axis represents the wear measurements for a given voltage. While the graph of FIG. 6 represents the data of the above described ski assembly 162, one should understand that with appropriate changes in the size of taper 130, the pressure of cleaning nap 102 may be optimized such that the wear on belt 14 is substantially uniform.

To install tapered ski assembly 162 in electrographic apparatus 10, one merely lines up fastener holes 141 of ski assembly 162 (see FIG. 2) with slots, not shown, but known in the art, of electrographic apparatus 10. Fasteners, such as screws, not shown, but known in the art are then inserted through holes 141 and hand tightened. Assembly 162 is then moved to position skis 125 and 126 such that a predetermined contact relationship is established between the back side of web 12 and skis 125 and 126. At this point the screws are tightened further to secure assembly 162 in fixed position within electrographic apparatus 10. This automatically positions skis 125 and 126 so that tapers 130 are positioned to relieve or dissipate any high pressure cause by high density nap 102 near the ends of magnetic roller 105. A uniform pressure is thereby maintained over the entire nip formed by skis 125 and 126 with magnetic roller 105 to assure a uniform cleaning, buffing and wear of web 14.

This assures that the surface on web 14 will be in a properly cleaned condition when presented to charging station 36.

In operation as web 14 travels in the nip formed by magnetic brush 105 with skis 125 and 126, nap 102, at the ends of magnetic brush 105, is denser than nap 102 between the ends of magnetic brush 105. Due to nap 102 being denser at the ends of magnetic brush 105, nap 102 is less compliant in those area and instead of nap 102 being displaced as it contacts web 14, as it is so displaced in the areas where nap 102 is not as dense, nap 102 displaces web 14. However, due to taper 130, web 14 may be displaced, in tapers 130, toward skis 125 and 126, thereby relieving or dissipating any potential for increase in pressure in the areas where nap 102 is of high density. In this manner a uniform pressure may be maintained in the full nip created by skis 125 and 126 with magnetic brush 105. Because of this ability to maintain a uniform pressure, magnetic brush 105 is able to uniformly clean web 14 and eliminate any uneven wear of web 14 that would create non-uniform, image disturbing, electrical properties in web 14.

Because skis 125 and 126, as above described, maintain the recording surface of web 14 in constant uniform pressure contact with nap 102 of magnetic brush 105, the removal of the residual toner particles, remaining on the surface of web 14, can be carried out efficiently as well as uniformly at all times. The toner particles thus removed from web 14 are collected in nap portion 102 of magnet brush 105 while it rotates, by means known in the art, but not shown.

The invention has been described in detail with particular reference to a preferred embodiment thereof, but it will be understood that variations and modifications can be effected within the spirit and scope of the invention.

We claim:

1. Apparatus for cleaning a recording medium in the form of an endless belt extended between at least a pair of rollers, having a recording surface on which a developed image comprised of particles is formed and a back surface opposite said recording surface, the cleaning apparatus comprising:

means for removing residual particles on the recording surface, said means for removing being disposed on the recording surface side of said recording medium;

supporting means for supporting the back surface of the recording medium, said supporting means including:

a support member having supporting surfaces which face the back side of said recording medium, and the supporting surfaces are both curved and tapered for maintaining the recording surface in uniform pressure contact with the means for removing residual particles.

2. The cleaning apparatus of claim 1 wherein the supporting surface is curved in the in-track direction and is defined by a pair of skis with each ski of the pair of skis having a tapered surface facing the back side of said recording medium.

3. The cleaning apparatus of claim 2 wherein said skis each have opposite ends which taper away from the recording medium.

4. A support apparatus for a recording medium in the form of an endless belt extended between at least a pair of rollers, having a recording surface on which a developed image is formed and a back surface opposite said recording surface, said support apparatus comprising:

a supporting member having supporting surfaces which face the back side of said recording medium, and the supporting surfaces are both curved and tapered for maintaining the recording surface in uniform pressure contact with the means for removing residual particles.

5. The support apparatus of claim 4 wherein the supporting surface is curved in the in-track direction and is defined by a pair of skis with each ski of the pair of skis having a tapered surface facing the back side of said recording medium.

6. The support apparatus of claim 5 wherein the skis are non-rotating skis and only a portion of the support surface slidingly engages the backside of the recording medium.

7. Apparatus for cleaning a recording medium in the form of an endless belt extended between at least a pair of rollers, having a recording surface on which a developed image comprised of particles is formed and a back surface opposite said recording surface, the cleaning apparatus comprising:

magnetic brush means for removing residual particles on the recording surface, said means for removing being disposed on the recording surface side of said recording medium;

supporting means for supporting the back surface of the recording medium, said supporting means including:

a support member having supporting surfaces which face the back side of said recording medium, and the supporting surfaces are both curved and tapered for maintaining the recording surface in uniform pressure contact with the means for removing residual particles.

8. The cleaning apparatus of claim 7 wherein the supporting surfaces are equidistant from the magnetic brush means.

* * * * *